US005459938A

United States Patent [19]

Knight et al.

[11] Patent Number: 5,459,938

[45] Date of Patent: Oct. 24, 1995

[54] GUIDE FOR BRICK LAYING

[76] Inventors: William F. Knight, 13717 Tobiasson Rd.; Roger J. Chaffee, 13718 Tobiasson Rd., both of Poway, Calif. 92064

[21] Appl. No.: 238,488

[22] Filed: May 5, 1994

[51] Int. Cl.[6] ..... G01B 5/16

[52] U.S. Cl. ..... 33/526; 33/518; 52/127.1; 52/645

[58] Field of Search ..... 52/747, 127.1, 52/384, 385, 389, 645, DIG. 1, DIG. 2; 33/518, 526, 527, 478, 1 G, DIG. 20; 404/99, 37; 108/64

[56] References Cited

U.S. PATENT DOCUMENTS

| | | | |
|---|---|---|---|
| 265,369 | 10/1882 | Barnhart | 108/64 |
| 1,649,282 | 11/1927 | Bishop . | |
| 3,254,417 | 6/1966 | Carmichael | 33/526 |
| 3,319,392 | 5/1967 | Fitzgerald | 52/389 |
| 3,775,856 | 12/1973 | Schmidt | 33/518 |
| 4,361,964 | 12/1982 | Hennessee | 33/478 |
| 4,712,309 | 12/1987 | Kingston et al. | 33/527 |
| 4,953,341 | 9/1990 | Joos | 52/747 |
| 5,033,241 | 7/1991 | Max | 52/385 |
| 5,201,130 | 4/1993 | Krchnak | 33/DIG. 20 |
| 5,251,419 | 10/1993 | Ohtsuka | 52/747 |

FOREIGN PATENT DOCUMENTS

| | | | |
|---|---|---|---|
| 723350 | 12/1965 | Canada | 52/747 |
| 749182 | 4/1944 | Germany | 52/DIG. 1 |
| 2162462 | 11/1972 | Germany | 52/DIG. 1 |
| 2825552 | 12/1979 | Germany | 404/99 |
| 4022832 | 1/1992 | Japan | 52/127.1 |

*Primary Examiner*—Carl D. Friedman
*Assistant Examiner*—Laura A. Saladino

[57] ABSTRACT

Disclosed is a new guide for brick laying for facilitating uniform arrangement of bricks during construction of floors, walkways, patios, and the like. The guide comprises a rectangular lattice panel having square openings for temporary placement flat on top of a prepared work area whereby bricks placed inside the square openings will automatically align to a desired pattern. A handle is included whereby a user may easily grasp the panel after brick placement to facilitate removal of the panel without disturbing alignment of the bricks. The lattice panel is separated longitudinally into hingedly connected left and right half panels for providing an operating position wherein the half panels extend coplanarly relative to each other and a storage/transport position wherein the right half panel is pivoted 180° to lie adjacent the left half panel. A latch is additionally included whereby the panels may be releasably locked in the operating position to prevent unwanted pivotal movement thereof.

1 Claim, 4 Drawing Sheets

GUIDE FOR BRICK LAYING

BACKGROUND OF THE INVENTION

1. Field of the Invention

The present invention relates to flooring systems and more particularly pertains to a guide for brick laying which may be adapted for facilitating uniform arrangement of bricks during construction of floors, walkways, patios, and the like.

2. Description of the Prior Art

The use of flooring systems is known in the prior art. More specifically, flooring systems heretofore devised and utilized for the purpose of constructing floors are known to consist basically of familiar, expected and obvious structural configurations, notwithstanding the myriad of designs encompassed by the crowded prior art which have been developed for the fulfillment of countless objectives and requirements.

The present invention is directed to improving devices for constructing floors in a manner which is safe, secure, economical and aesthetically pleasing.

U.S. Pat. No. 4,631,833 to Moye describes a guide bracket for brick laying which provides a guide for constructing brick corners in which the corner is constructed from a plurality of stacked brick layers which are spaced apart from each other by a joint. The invention disclosed in the Moye patent does not show a way to uniformly arrange bricks during construction of floors, walkways, patios, and the like.

The prior art also discloses a flooring system and method of providing as shown in U.S. Pat. No. 4,905,437 to Heather, a method of laying tile-like flooring members on a floor of U.S. Pat. No. 4,744,194 to Yasuyoshi, an apparatus for laying tiles disclosed in U.S. Pat. No. 4,893,451 to Valente, and a grid system for laying out and/or precutting tiles or the like in U.S. Pat. No. 4,311,464 to Messina. While these devices fulfill their respective, particular objectives and requirements, the aforementioned patents do not disclose a guide for brick laying for facilitating uniform arrangement of bricks during construction of floors, walkways, patios, and the like.

In this respect, the guide for brick laying according to the present invention substantially departs from the conventional concepts and designs of the prior art, and in so doing provides an apparatus primarily developed for the purpose of facilitating uniform arrangement of bricks during construction of floors, walkways, patios, and the like.

Therefore, it can be appreciated that there exists a continuing need for a new guide for brick laying which can be used for facilitating uniform arrangement of bricks during construction of floors, walkways, patios, and the like. In this regard, the present invention substantially fulfills this need.

As illustrated by the background art, efforts are continuously being made in an attempt to develop devices for constructing floors. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of flooring systems now present in the prior art, the present invention provides a new flooring system construction wherein the same can be utilized for facilitating uniform arrangement of bricks during construction of floors, walkways, patios, and the like. As such, the general purpose of the present invention, which will be described subsequently in greater detail, is to provide a new guide for brick laying apparatus and method which has all the advantages of the prior art flooring systems and none of the disadvantages.

The invention is defined by the appended claims with the specific embodiment shown in the attached drawings. For the purpose of summarizing the invention, the invention may be incorporated into a new guide for brick laying for facilitating uniform arrangement of bricks during construction of floors, walkways, patios, and the like. The guide for brick laying comprises a rectangular lattice panel for temporary placement flat on top of a prepared work area. The panel is formed of a plurality of columns of plastic strips interconnected with a plurality of rows of plastic strips defining essentially identical square openings therebetween. The plastic strips all have essentially the same width and thickness. The openings each have dimensions to snugly receive a pair of collaterally coplanarly disposed conventional construction bricks therein such that an open space exists between the adjacent long edges of the bricks. Handle means, whereby a user may grasp the panel after brick placement, is included to facilitate removal of the panel without disturbing arrangement of the bricks. The lattice panel is separated longitudinally into left and right half panels. The half panels are pivotally connected together with hinge means whereby providing an operating position wherein the half panels extend coplanarly relative to each other and a storage/transport position wherein the right half panel is pivoted 180° to lie adjacent the left half panel. The guide for brick laying further includes latch means whereby the panels may be releasably locked in the operating position to prevent unwanted pivotal movement thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new guide for brick laying for facilitating uniform arrangement of bricks during construction of floors, walkways, patios, and the like.

It is another object of the present invention to provide a new guide for brick laying which may be easily and efficiently manufactured and marketed.

It is a further object of the present invention to provide a new guide for brick laying which is of a durable and reliable construction.

An even further object of the present invention is to provide a new guide for brick laying which is susceptible of a low cost of manufacture with regard to both materials and labor, and which accordingly is then susceptible of low prices of sale to the consuming public, thereby making such guides for brick laying economically available to the buying public.

Still yet another object of the present invention is to provide a new guide for brick laying which provides in the apparatuses and methods of the prior art some of the advantages thereof, while simultaneously overcoming some of the disadvantages normally associated therewith.

Still yet another object of the present invention is to provide a new guide for brick laying that is reusable therefore having an economic advantage over other guides that become a permanent component of the floor.

Yet another object of the present invention is to provide a new guide for brick laying that may be used to align bricks in a variety of different patterns without modification of the bricks or the guide.

Even still another object of the present invention is to provide a new guide for brick laying that enables even inexperienced users to obtain professional-looking results.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
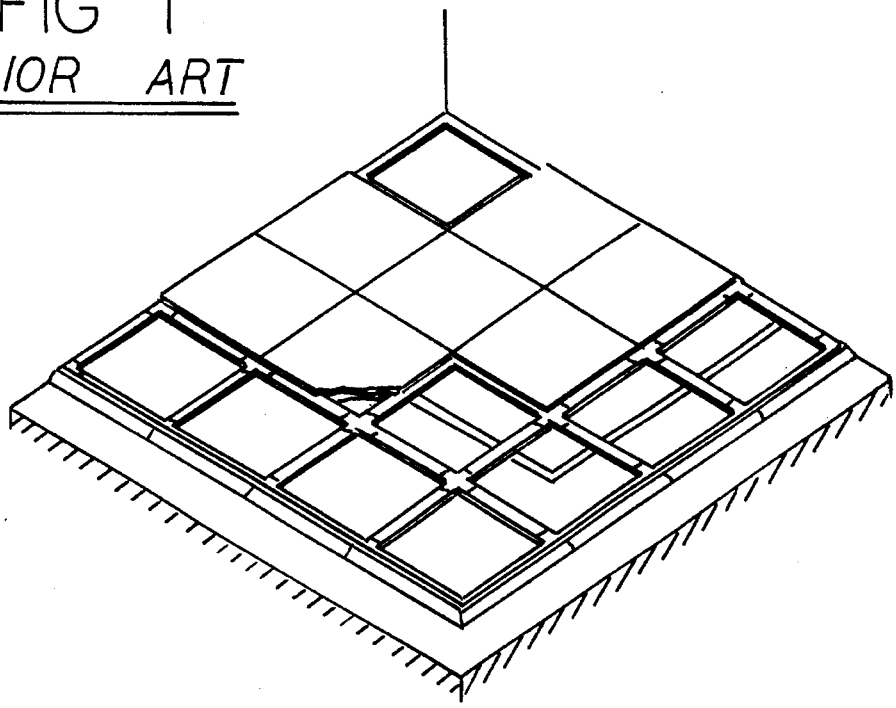
FIG 1 PRIOR ART
FIG. 1 is a top perspective view of a prior art flooring system.
Figure 2:
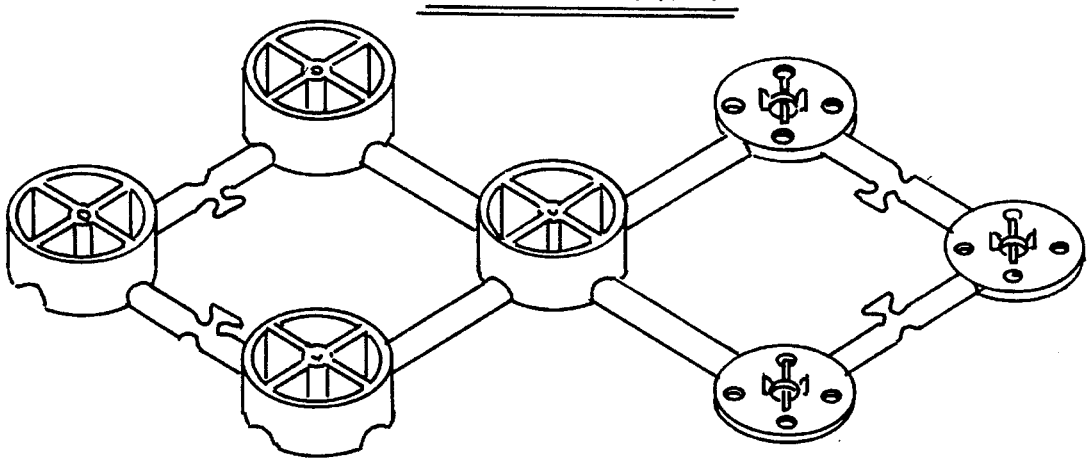
FIG 2 PRIOR ART
FIG. 2 is a top perspective view of a second prior art flooring system.
Figure 3:
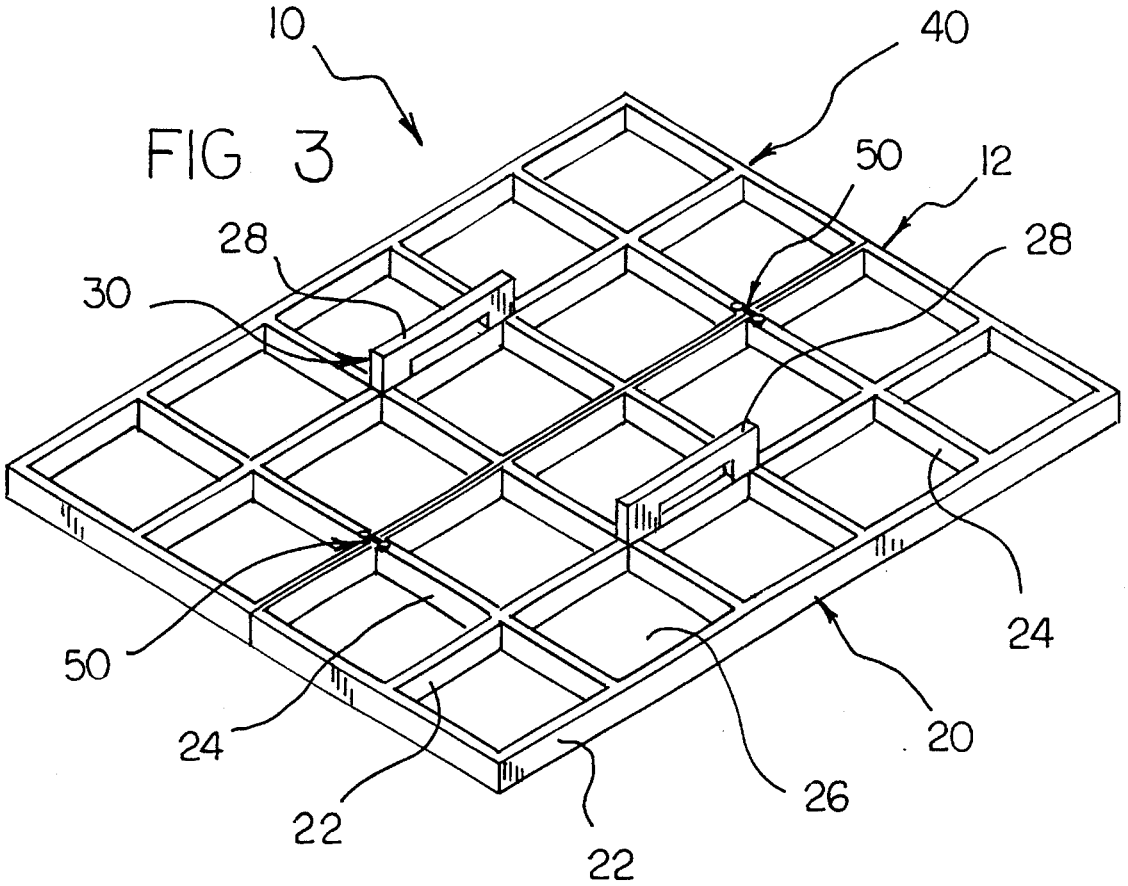
FIG. 3 is a top perspective view of the present new guide for brick laying shown in the operational position.
Figure 4:
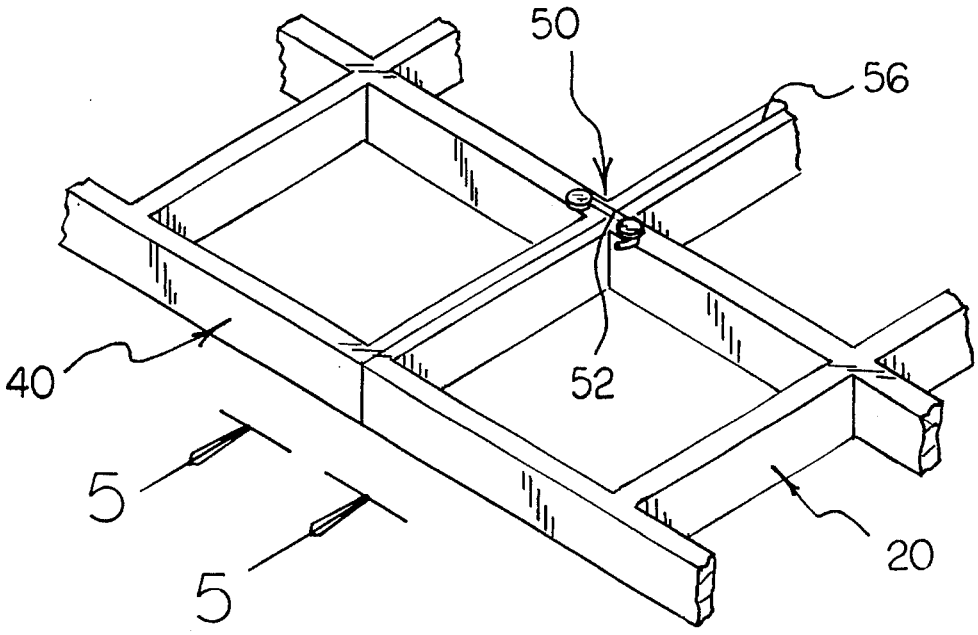
FIG. 4 is a top perspective detail view of the invention of FIG. 3 showing one of the hook fastener assemblies of the latch means of the preferred embodiment.
Figure 5:
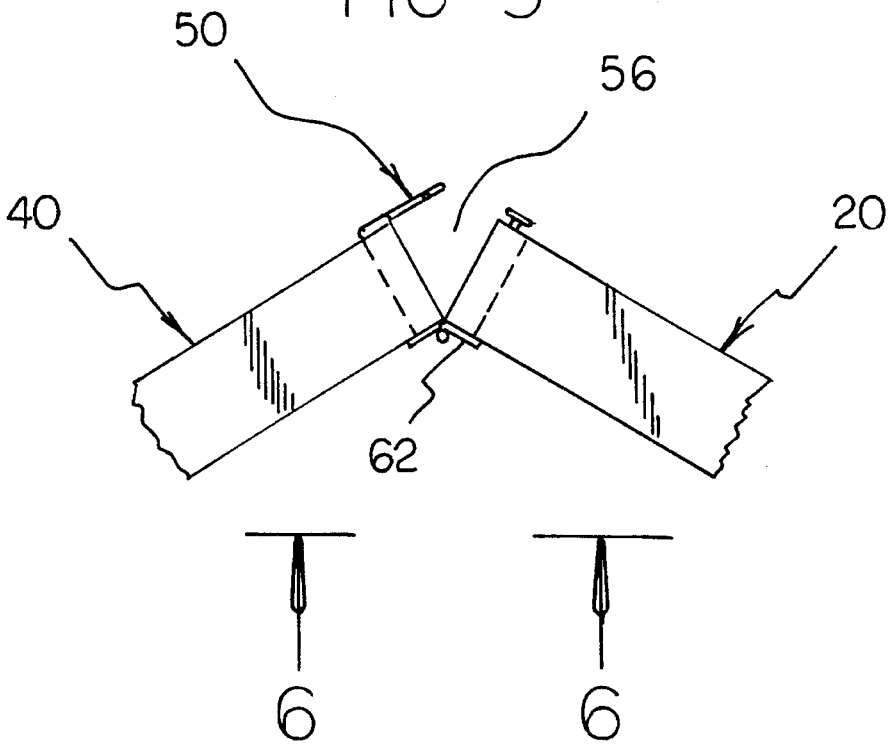
FIG. 5 is a front elevational detail view of the invention of FIG. 4 showing the manner of hinge operation of the half panels.
Figure 6:
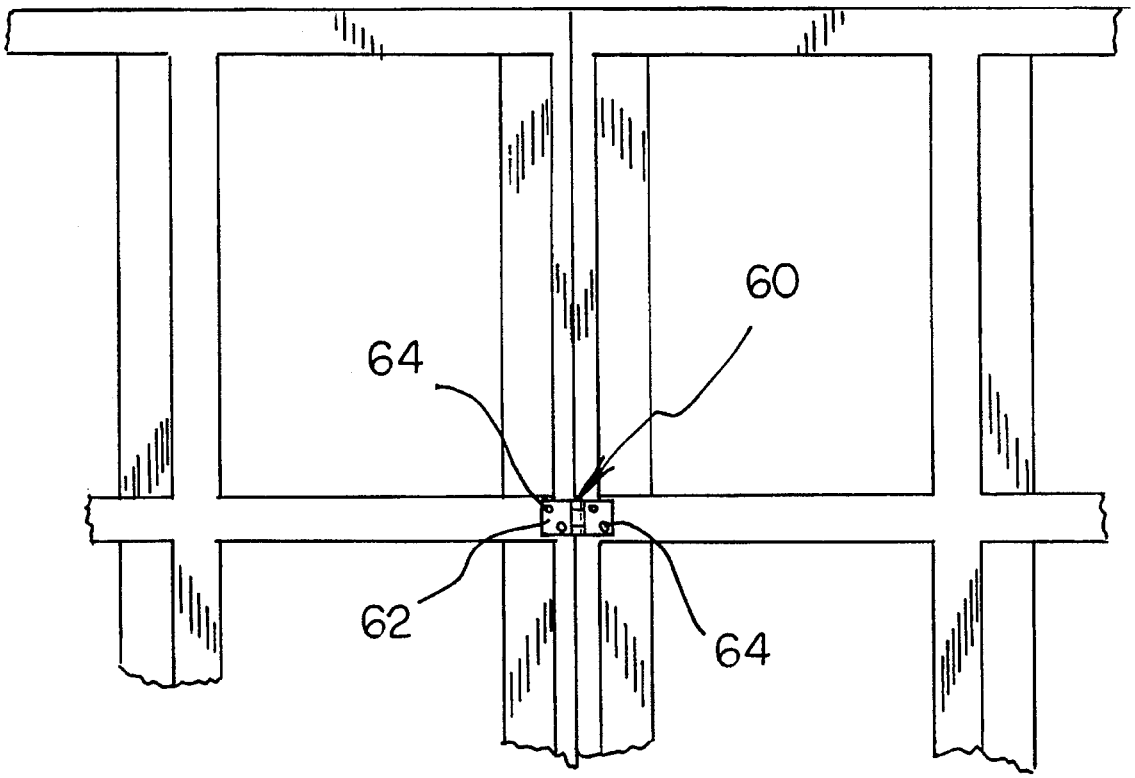
FIG. 6 is a bottom plan detail view of the invention of FIG. 5 showing one of the hinge assemblies of the preferred embodiment.

With reference now to the drawings, and in particular to FIG. 3 thereof, a new guide for brick laying embodying the principles and concepts of the present invention and generally designated by the reference numeral 10 will be described.

From an overview standpoint, the guide for brick laying is adapted for use for facilitating uniform arrangement of bricks during construction of floors, walkways, patios, and the like. See FIG. 8.

With reference now to FIGS. 3–8 and more specifically, it will be noted that a new guide for brick laying 10 is shown. The guide for brick laying 10 comprises a rectangular lattice panel 12 for temporary placement flat on top of a prepared work area. The panel 12 is formed of five columns 22 of plastic strips interconnected with six rows 24 of plastic strips defining twenty essentially identical square openings 26 therebetween. The plastic strips 22 and 24 all have essentially the same width as the height of a conventional construction brick 70 and are approximately ½-inch thick.

The openings 26 each have dimensions to snugly receive a pair of collaterally coplanarly disposed bricks 70 and 72 therein such that a ½-inch wide open space 74 exists between the adjacent long edges of the bricks 70 and 72. Handle means 30, whereby a user may grasp the panel 12 after brick placement, is included to facilitate removal of the panel 12 without disturbing arrangement of the bricks 70 and 72. The handle means comprises a pair of integrally formed spaced apart ears 28 projecting upwardly normal the major plane of the panel 12.

The lattice panel 12 is separated longitudinally into left and right half panels 40 and 20. The half panels 40 and 20 are pivotally connected together with hinge means 60 whereby providing an operating position wherein the half panels 40 and 20 extend coplanarly relative to each other and a storage/transport position wherein the right half panel 20 is pivoted 180° to lie adjacent the left half panel 40. The hinge means 60 comprises two hinge assemblies 62 attached to adjacent bottom edges of the left and right lattice panels 40 and 20 with a plurality of screws 64 such that the panels 40 and 20 may pivot between the operating position and the storage/transport position.

The guide for brick laying 10 further includes latch means 50 whereby the panels 40 and 20 may be releasably locked in the operating position to prevent unwanted pivotal movement thereof. The latch means 50 comprises two spaced apart hook fastener assemblies 52 attached to adjacent top edges of the left and right lattice panels 40 and 20. The hook fastener assemblies 52 extend in bridging fashion across the separation 56 between the half panels 40 and 20 when locked.

Figure 7:
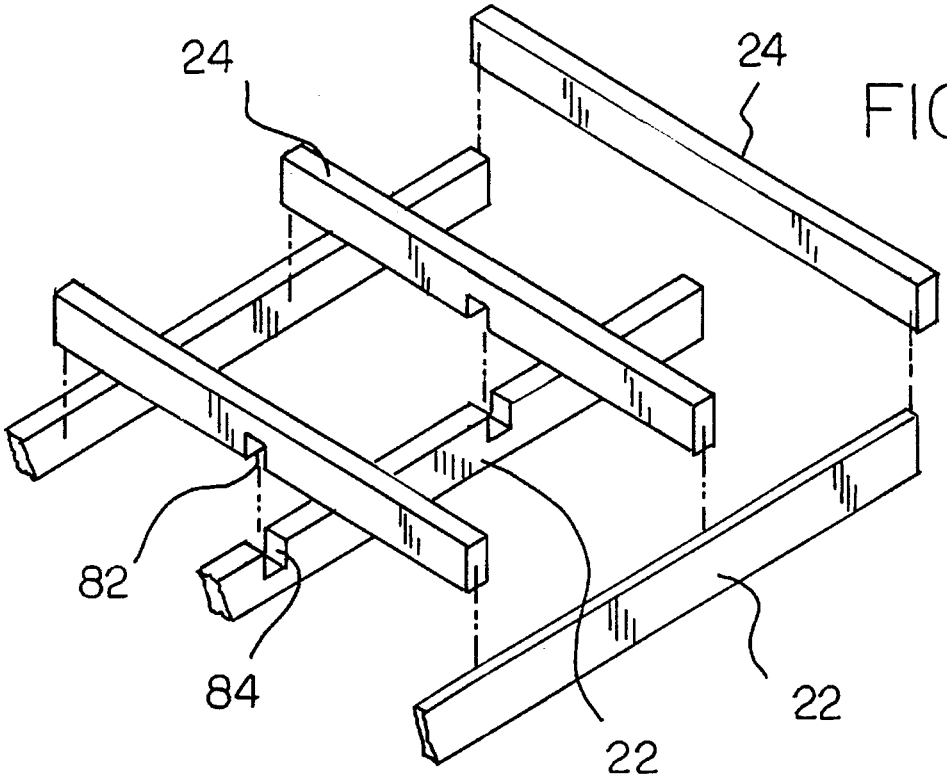
FIG. 7 is a partial top perspective view of the present invention showing the manner of lattice panel construction of the preferred embodiment.

As shown in FIG. 7, the plastic strips 22 and 24 which make up the lattice panel 12 are assembled by means of mutually engageable facing notches 82 and 84 formed in each strip 22 and 24 where they intersect with each other.

Figure 8:
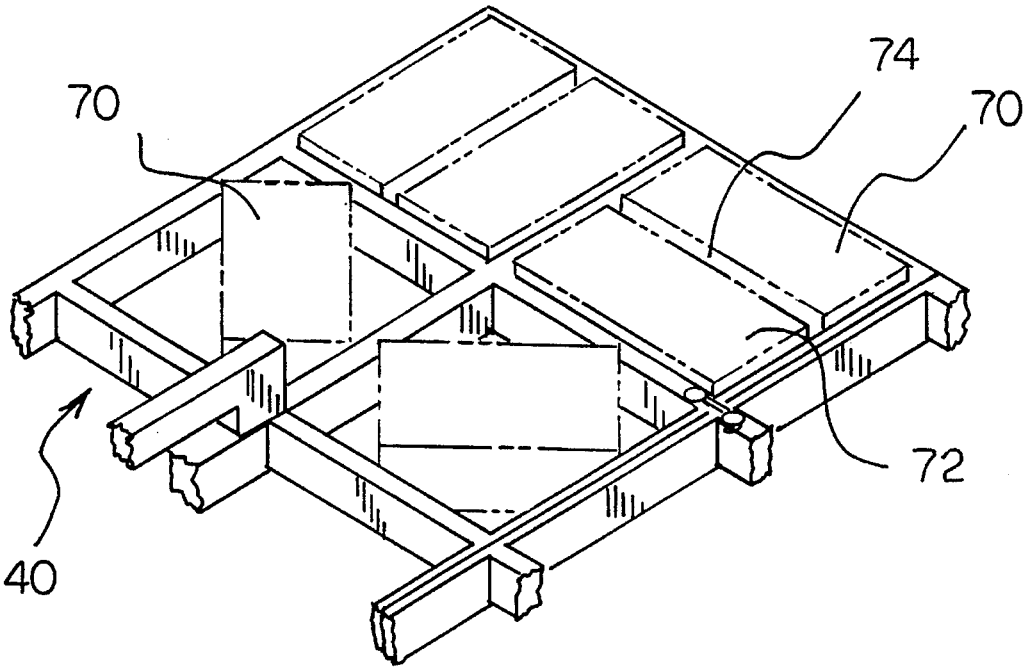
FIG. 8 is a partial top perspective view of the new guide for brick laying illustrating different manners of aligning bricks within the lattice panel square openings.

Referring now to FIG. 8, in use the new guide for brick laying 10 is extended to the operating position, being locked in place with the latch means 50. The guide 10 is placed flat, handles 28 extending upwardly, on a prepared levelled area to be covered with bricks. Bricks 70 and 72 are gently placed within the square openings 26 in the lattice panel 12 and gently shifted to flushly abut the strips 22 and 24. After the desired number of bricks are laid, the guide 10 is gently lifted away from the work area leaving the bricks in perfect alignment. If additional bricks are to be placed to extend the bricked area, the guide 10 is placed with an outside strip 22 or 24 abutting the last column of previously laid bricks, continuing in this fashion until the job is completed. The bricked area may be backfilled with sand or mortar mix to retain bricks and finish surface.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new guide for brick laying for facilitating uniform arrangement of bricks during construction of floors, walkways, patios, and the like, the guide for brick laying comprising:

a rectangular lattice panel for temporary placement flat on top of a prepared work area, the panel being formed of a plurality of columns of thick plastic strips interconnected with a plurality of rows of thick plastic strips defining essentially identical square openings therebetween, the openings permitting the positioning of two bricks therein with a space therebetween, the plastic strips all having essentially identical width and thickness, the thickness of each strip being appropriately sized to firmly retain conventional bricks, the openings each having dimensions to snugly receive a pair of collaterally coplanarly disposed conventional construction bricks therein such that an open space exists between the adjacent long edges of the bricks, the space having a width essentially equal the thickness of a plastic strip; and handle means whereby a user may grasp the panel after brick placement to facilitate removal of the panel without disturbing arrangement of the bricks, the handle means comprising a pair of integrally formed spaced apart ears projecting upwardly normal the major plane of the panel, the handle means being positioned adjacent to the approximate center point of the lattice panel to provide leverage to the user when transporting and placing the panel;

the lattice panel being separated longitudinally into left and right half panels, the half panels being pivotally connected together with hinge means whereby providing an operating position wherein the half panels extend coplanarly relative to each other and a storage/transport position wherein the right half panel is pivoted 180 degrees to lie adjacent to the left half panel, the hinge means comprising a plurality of hinge assemblies attached to adjacent bottom edges of the left and right lattice panels such that the panels may pivot between the operating position and the storage/transport position; and latch means whereby the panels may be releasably locked in the operating position to prevent unwanted pivotal movement thereof, the latch means comprising a plurality of spaced apart hook fastener assemblies attached to adjacent top edges of the left and right lattice panels in bridging fashion across the separation therebetween when locked, the latch means comprising first and second generally cylindrical shaped knobs, a J-shaped hook having a linear end affixed to a first knob and a curved end positioned around a second knob, the latch means permitting convenient one handed locking and unlocking thereof.

* * * * *